US011763759B2

(12) United States Patent
Hsieh et al.

(10) Patent No.: US 11,763,759 B2
(45) Date of Patent: Sep. 19, 2023

(54) HIGH COLOR AND NARROW COLOR GAMUT DISPLAY PANEL

(71) Applicant: HEWLETT-PACKARD DEVELOPMENT COMPANY, L.P., Spring, TX (US)

(72) Inventors: Hsing-Hung Hsieh, Taipei (TW); Thong Thai, Spring, TX (US); Mario Campos, Spring, TX (US); Gregory Staten, Spring, TX (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/784,732

(22) PCT Filed: Dec. 13, 2019

(86) PCT No.: PCT/US2019/066297

§ 371 (c)(1),
(2) Date: Jun. 13, 2022

(87) PCT Pub. No.: WO2021/118601

PCT Pub. Date: Jun. 17, 2021

(65) Prior Publication Data

US 2023/0005440 A1 Jan. 5, 2023

(51) Int. Cl.

| | |
|---|---|
| ***G09G 3/34*** | (2006.01) |
| ***G09G 3/32*** | (2016.01) |
| ***G09G 3/36*** | (2006.01) |

(52) U.S. Cl.

CPC ..... *G09G 3/3413* (2013.01); *G09G 3/32* (2013.01); *G09G 3/3607* (2013.01)

(58) Field of Classification Search

CPC ..... G09G 3/3413
USPC ..... 345/88
See application file for complete search history.

(56) References Cited

U.S. PATENT DOCUMENTS

| | | | | |
|---|---|---|---|---|
| 7,679,614 | B2 | 3/2010 | Yamada et al. | |
| 7,692,642 | B2 | 4/2010 | Wyatt | |
| 9,318,069 | B2 | 4/2016 | Nambi et al. | |
| 9,495,926 | B2 | 11/2016 | Tripathi et al. | |
| 9,711,111 | B2 | 7/2017 | Atkins | |
| 9,786,255 | B2 | 10/2017 | Verbeure et al. | |
| 2010/0225640 | A1 | 9/2010 | Vieri et al. | |
| 2013/0020955 | A1* | 1/2013 | Igaki | H05B 45/20 315/210 |
| 2013/0076262 | A1* | 3/2013 | Noguchi | H05B 45/20 315/297 |

(Continued)

FOREIGN PATENT DOCUMENTS

| | | | |
|---|---|---|---|
| CN | 206906755 | U | 1/2018 |
| CN | 109031780 | A | 12/2018 |

(Continued)

*Primary Examiner* — Long D Pham
(74) *Attorney, Agent, or Firm* — QUARLES & BRADY LLP

(57) ABSTRACT

In an example implementation according to aspects of the present disclosure, a display panel is described including a set of high color gamut light emitting diodes (LEDs), a set of narrow color gamut LEDs, a light guide plate wherein the set of high color gamut LEDs alternate positions with the set of narrow color gamut LEDs, and a switch to toggle between the sets of LEDs.

12 Claims, 3 Drawing Sheets

(56) References Cited

U.S. PATENT DOCUMENTS

| | | | | |
|---|---|---|---|---|
| 2016/0358556 | A1 | 12/2016 | Zhan et al. | |
| 2017/0032725 | A1 | 2/2017 | Li et al. | |
| 2020/0319508 | A1* | 10/2020 | Hsieh | G09G 3/3413 |

FOREIGN PATENT DOCUMENTS

| | | | |
|---|---|---|---|
| EP | 2439727 | B1 | 11/2017 |
| TW | 200736734 | A | 10/2007 |
| TW | I522998 | B | 2/2016 |

* cited by examiner

HIGH COLOR AND NARROW COLOR GAMUT DISPLAY PANEL

BACKGROUND

Display systems present video renderings through display panels. The display panel can include a liquid crystal display and a backlighting system.

DETAILED DESCRIPTION

When selecting a liquid crystal display (LCD) panel for a computing system, often a user, either the system integrator or the end-user, makes a trade off of potential display options and attributes. Options include high power consumption for higher performance or low performance for energy savings. The performance may be determined in terms of refresh rate and color gamut.

A high refresh panel may benefit many applications including ones with fast motion images such as watching movies, playing games, and inking. The high refresh rate has a downside as it consumes higher amounts of power. Likewise, the backlight light emitting diode (LED) which leads to wider color gamut in an LCD display, also consumes higher power. Lower power LED backlights result in narrower color gamut.

In some instances, when the refresh rate is high, the color gamut may not be noticeable. In this instance, high color gamut may be superfluous. Gaming content often moves so fast that absolute color accuracy may not be relevant or valuable. Creative content, retouching photos or color correcting film, may be an instance where high color gamut matters most.

A configurable high color gamut display panel is described herein. The high color gamut display panel provides an end-user or a system integrator a configuration option to operate the liquid crystal display in a variety of display modes. The display modes include but are not limited to a high color gamut mode for creative applications, a narrow color gamut mode with high refresh rate for fast motion images, and a narrow gamut mode with low refresh rate for minimizing power consumption of the display panel and likewise the integrated system.

Figure 1:
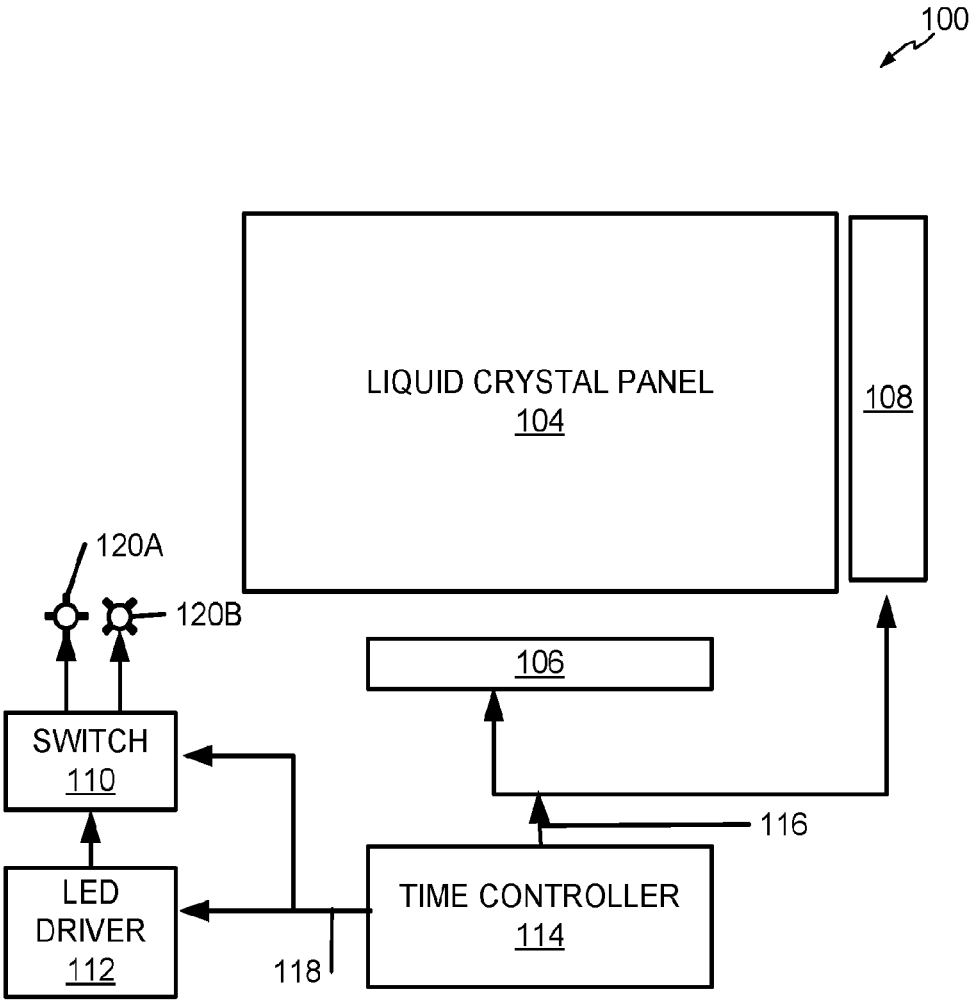
FIG. 1 illustrates a high color gamut display panel, according to an example.

FIG. 1 illustrates a high color gamut display panel 100. The high color gamut display panel 100 may include a liquid crystal display (LCD) 104, a time controller 114, and an LED driver 112. The high color gamut display panel 100 may be incorporated with a display device or a display system. The display device or display system may incorporate other ancillary components including but not limited to casing, bezels, digitizers, cameras, and power systems. As described here the fundamental operation of the combination of the gate driver 108 and source driver 106 may continue standards of industry operation. For example, the gate driver 108 may turn on the transistor within each pixel cell on a horizontal row of an LCD 104. Once the gate driver 108 turns on the transistor, the source driver 106 may generate voltages that are applied to the liquid crystal with each pixel cell on that row for data input. The LCD 104, the source driver 106 and the gate driver 108 may remain unchanged from a standard display implementation.

The time controller 114 may coordinate the high color gamut display panel 100. The time controller 114 may receive a display panel configuration. The time controller 114 may be communicatively coupled to the source driver 106, the gate driver 108, the LED driver 112, and a switch 110. The time controller 114 transmits a display signal 116 and a backlight signal 118. The time controller 114 may synchronize the display signal 116 and the backlight signal 118 to configure a combination of a color gamut value and a refresh rate value based on a display panel configuration. The display panel configuration may include an operation refresh rate and a specified color gamut. The display panel configuration may be a data structure capable of being encoded and decoded by the time controller 114. In another implementation, the display panel configuration may be decoded and decomposed by another system, and the resultant parts (including refresh rate and color gamut) may be transmitted to the time controller 114. Table 1 shows a corresponding display panel configuration for a specific user profile:

TABLE 1

| User Profile | Refresh rate | Color Gamut |
|---|---|---|
| Gaming | 240 Hz | sRGB |
| Creator (Photo) | 60 Hz | DCI P3 |
| Creator (Film) | 120 Hz | DCI P3 |
| Mobile Professional (max battery | 60 Hz | sRGB |

The time controller 114 may transmit a received display panel configuration refresh rate as the display signal 116 to the source driver 106 and the gate driver 108. The display signal 116 may control the gate driver 108 and source driver 106. As such, the display LCD 104 may be refreshed at different rates, e.g. 60 Hz, 120 Hz, 144 Hz, 240 Hz, 300 Hz, etc.

The time controller 114 may also transmit a backlight signal 118 to the light emitting diode (LED) driver 112 and the switch 110. The backlight signal 118 controls LED driver 112 to light on LEDs. Further, the backlight signal 118 provides control instructions to the switch 110. The switch 110 may decide which set of LEDs to be light on. The LED driver 112 may control power output to the LEDs thereby extending battery life and enhance LCD display panel performance through heightened dimming methods. The LED driver 112 may also implement electromagnetic interference mitigation techniques, selectable switching frequency, and fault protection notification. In an example, the LED driver 112 may control the switch 110 based on information received in the backlight signal 118.

The display panel configuration may be received via an open application programming interface (API) from a user controllable application. For instance, a user may manually select a combination and refresh rate and a color gamut for their specific use case through a user accessible application. Alternatively, an automated system executing on a host device of the high color gamut display panel may detect a use case based on the executing application. For example, if a video editing application is executing on the host device, the automated system may detect that application and send a display panel configuration to the time controller 114 indicating high refresh and high color gamut.

In another implementation, the display panel configuration may be remotely locked. In an effort to differentiate products yet use the same bill of materials, the display panel configuration may be locked at production. In this implementation, the time controller 114 may discard any newly received display panel configuration. In another implementation, the display panel configuration may be restricted. The time controller 114 may receive authentication and authorization in the display panel configuration to effect any change. For example, the high color gamut display receives an initial display panel configuration. In an example, the user may request and pay for additional functionality of the high color gamut display. Upon receipt of payment, an automated system may send a display panel configuration including authentication and authorization to enable configurations that were previously not accessible. Likewise, upon production, the high color gamut display panel may be shipped in a configuration. Upon installation, the time controller 114 may receive a display panel configuration to lock the refresh rate and color gamut from a remote source. In some implementations, the display panel configuration may be propagated to the high color gamut display panel through the host device via a communication channel in the display connection.

Communicatively coupled to the switch may be a high color gamut LED 120A and a narrow color gamut LED 120B. For simplicity and ease of understanding the high color gamut LED 120A and the narrow color gamut LED 120B are illustrated in FIG. 1 as a single LED. However, in implementation, the high color gamut LED 120A and the narrow color gamut LED 120B may be a corresponding set of high color gamut LEDs and a corresponding set of narrow color gamut LEDs.

The switch 110 may toggle between the high color gamut LED 120A and the narrow color gamut LED 120B. In some implementations, the backlight signal 118 provides the LED driver 112 with the display panel configuration detail determinative of which LED to toggle. The LED driver 112 toggles the switch to activate the specified LED backlight. In another implementation, an LED driver 112 may not be aware of the existence of the dual LED-type configuration. In this implementation, the time controller 114 may transmit the backlight signal 118 directly to the switch 110 to toggle the switch 110 independently. This implementation may include the use of pre-existing LED drivers 112.

Figure 2A:
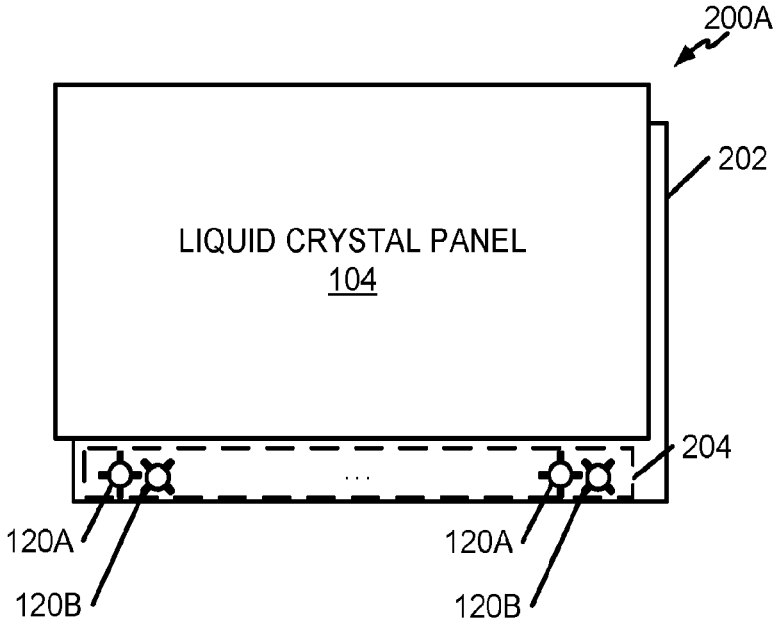
FIGS. 2A and 2B illustrate examples of high color gamut display panels.

FIG. 2A illustrates an example of a high color gamut display panel 200A with a single light guide plate. As described in reference to FIG. 1, the high color gamut LED 120A and the narrow color gamut LED 1208 may be described in terms of sets of LEDs of the same type. For example, the high color gamut LED 120A may correspond to a set of high color gamut LEDs and the narrow color gamut LED 120A may correspond to a set of narrow color gamut LEDs.

In this implementation a high color gamut display panel 200A may include an LCD 104, a light guide plate 202, and an LED array 204. The LCD 104 may be similar to the one referenced in FIG. 1 in that it may be implemented with the corresponding source driver 106, gate driver 108 and time controller 114. The light guide plate 202 provides the backlighting for the LCD 104. The light guide plate 202 provides physical structure to support the LED array 204 and may channel backlight through the LCD 104.

The LED array 204 may include alternating high color gamut LEDs 120A, and narrow color gamut LEDs 120B. Each of the same-type LEDs are communicatively coupled to the switch 110 in FIG. 1. As such, each of the same-type LEDs operate synchronously with each of the same-type. For example, if one high color gamut LED 120A is toggled, all of high color gamut LEDs within the LED array 204 may be toggled to the same state. At any given time, all of the same-type LEDs are in the same state. In another implementation, sections of the high color gamut display panel 200A may be configured independently based on application executing within that digital graphical space. For example, a user may be utilizing an application such as movie editing software on a portion of the display, and the user may be utilizing an email client on the other portion of the screen. In this example, the time controller 114 may toggle the set of high color gamut LEDs for the portion of displaying the movie editing software, and may toggle the set of narrow color gamut LEDs for the portion displaying the email client.

As the LEDs array 204 may include the alternating high color gamut LEDs 120A and the narrow color gamut LEDs 1206, the light guide plate 202 may offer full backlighting support to the LCD 104. In one implementation, when the set of high color gamut LEDs within the LED array 204 are enabled, the set of narrow color gamut LEDs within the LED array 204 are disabled. Additionally, when the set of narrow color gamut LEDs within the LED array 204 are enabled, the set of high color gamut LEDs within the LED array 204 are disabled. Utilizing the multiple sets of differing and alternating LEDs allows a single LCD 104 to support multiple color gamuts.

FIG. 26 illustrates an example of a high color gamut display panel 200B with multiple light guide plate. The high color gamut display panel 200B may include a liquid crystal display 104, a high color gamut light guide plate 206 and a narrow color gamut light guide plate 208. The high color gamut light guide plate 206 and the narrow color gamut light guide plate 208 may be planarly parallel and stacked upon another in a cohesive assembly with the LCD 104. The high color gamut light guide plate 206, the narrow color gamut light guide plate 208, and the LCD 104 are stacked in parallel planes.

The high color gamut light guide plate 206 may include a high color gamut LED array 210. The high color gamut LED array 210 may include an array of homogenous LEDs such as the high color gamut LED 120A. The high color gamut LED array 210 of the high color gamut light guide plate 206 may provide one of two illumination sources. Likewise, the narrow color gamut light guide plate 208 may include a narrow color gamut LED array 212. The narrow color gamut LED array 212 of the narrow color gamut light guide plate 208 may provide the second of two illumination sources. The narrow color gamut LED array 212 may include an array of homogenous LEDs such as the narrow color gamut LED 120B.

Figure 2B:
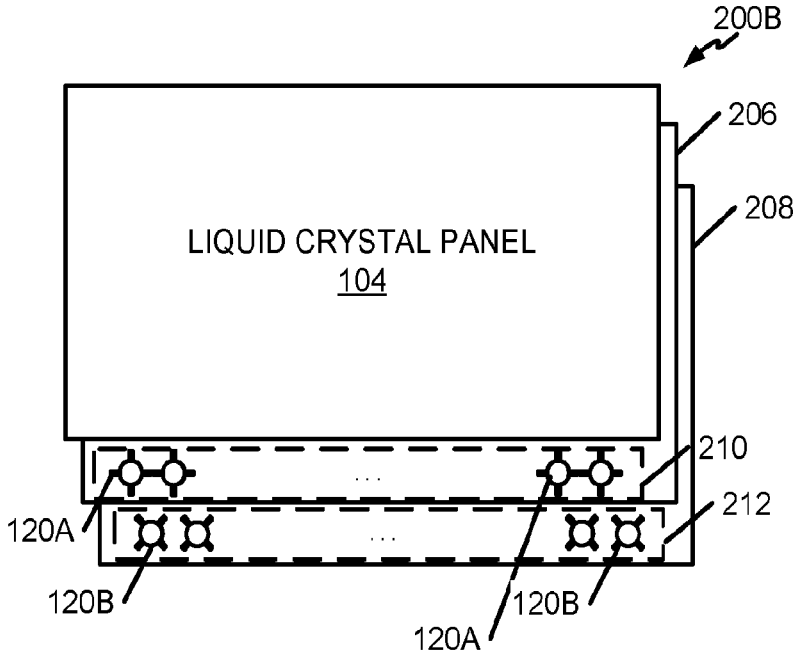

The high color gamut LED array 210 and the narrow color gamut LED array 212 may be offset from one another. For example, in the cohesive stacked assembly, a narrow color gamut LED 120B may physically reside in between two high color gamut LEDs 120A, however the narrow color gamut LED 120B may be located in a parallel plane to the high color gamut LEDs 120A within the narrow color light guide plate 208. Likewise, the high color gamut LEDs 120A reside within the high color gamut light guide plate 206 and maintain the same offset relationship from the narrow color gamut LEDs 120B. Utilizing the approach illustrated in FIG. 2B. existing light guide plates may be utilized to create the same, effect as illustrated in FIG. 2A without the redesign of a light guide plate and the construction of a new alternating LED array. In this implementation, the switch 110 of FIG. 1 may toggle the high color gamut. LED array 210 and the narrow color gamut LED array 212, and the LEDs inclusive to each array, thereby toggling from one illumination source to the other.

Figure 3:
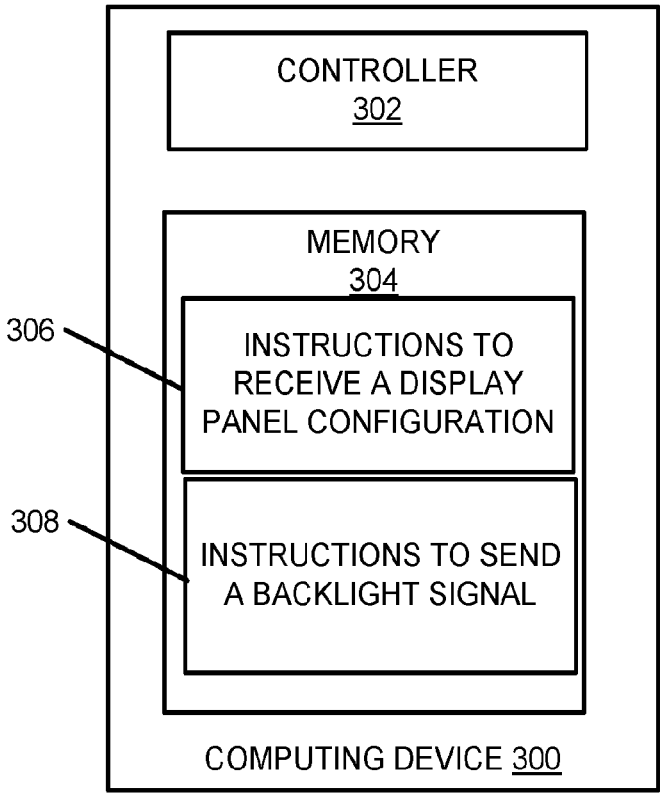
FIG. 3 is a computing device for supporting instructions for configuring a high color gamut display panel, according to an example.

FIG. 3 is a computing device 300 for supporting a high color gamut display panel, according to an example. The computing device 300 depicts a controller 302 and a memory device 304 and, as an example of the computing device 300 performing its operations, the memory device 304 may include instructions 306-308 that are executable by the controller 302. The controller 302 may be synonymous with the timing controller 114 referenced in FIG. 1. The controller 302 may include but is not limited to central processing units (CPUs), field programmable gate arrays (FPGAs) and graphical processing units (GPUs). The memory device 304 can be said to store program instructions that, when executed by controller 302, implement the components of the computing device 300. The executable program instructions stored in the memory device 304 include, as an example, instructions to receive a display panel configuration 306 and instructions to send a backlight signal 308 wherein the backlight signal indicates for the LED driver to toggle a set of high color gamut LEDs in a light gate plate or to toggle a set of narrow gamut LEDs in the light guide plate. Additionally, instructions may include sending a display signal to a source driver and a gate driver, wherein the display signal indicates a refresh rate.

Memory device 304 represents generally any number of memory components capable of storing instructions that can be executed by controller 302. Memory device 304 is non-transitory in the sense that it does not encompass a transitory signal but instead is made up of at least one memory component configured to store the relevant instructions. As a result, the memory device 304 may be a non-transitory computer-readable storage medium. Memory device 304 may be implemented in a single device or distributed across devices. Likewise, controller 302 represents any number of processors capable of executing instructions stored by memory device 304. Controller 302 may be integrated in a single device or distributed across devices. Further, memory device 304 may be fully or partially integrated in the same device as controller 302, or it may be separate but accessible to that device and controller 302.

In one example, the program instructions 306-308 can be part of an installation package that, when installed, can be executed by controller 302 to implement the components of the computing device 300. In this case, memory device 304 may be a portable medium such as a CD, DVD, or flash drive, or a memory maintained by a server from which the installation package can be downloaded and installed. In another example, the program instructions may be part of an application or applications already installed. Here, memory device 404 can include integrated memory such as a hard drive, solid state drive, or the like.

It is appreciated that examples described may include various components and features. It is also appreciated that numerous specific details are set forth to provide a thorough understanding of the examples. However, it is appreciated that the examples may be practiced without limitations to these specific details. In other instances, well known methods and structures may not be described in detail to avoid unnecessarily obscuring the description of the examples. Also, the examples may be used in combination with each other.

Reference in the specification to "an example" or similar language mean that a particular feature, structure, or characteristic described in connection with the example is included in at least one example, but not necessarily in other examples. The various instances of the phrase "in one example" or similar phrases in various places in the specification are not necessarily all referring to the same example.

It is appreciated that the previous description of the disclosed examples is provided to enable any person skilled in the art to make or use the present disclosure. Various modifications to these examples will be readily apparent to those skilled in the art, and the generic principles defined herein may be applied to other examples without departing from the scope of the disclosure. Thus, the present disclosure is not intended to be limited to the examples shown herein but is to be accorded the widest scope consistent with the principles and novel features disclosed herein.

What is claimed is:

1. A display panel comprising:

a set of high color gamut light emitting diodes (LEDs);

a set of narrow color gamut LEDs;

a light guide plate, wherein the set of high color gamut LEDs are configured in alternating positions with the set of narrow color gamut LEDs;

a switch to toggle illumination between the set of high color gamut LEDs and the set of narrow color gamut LEDs; and a time controller, wherein the time controller synchronizes a backlight signal for controlling the switch and a display signal to a configuration combination of a color gamut value and a refresh rate value.

2. The display panel of claim 1, further comprising an LED driver, wherein the LED driver controls the switch.

3. The display panel of claim 2, further comprising the time controller, wherein the time controller transmits the backlight signal to the LED driver and the switch.

4. The display panel of claim 3, wherein the time controller transmits the display signal to a source driver and a gate driver.

5. The display panel of claim 1, wherein the color gamut value and refresh rate value are configurable from a user accessible application.

6. The display panel of claim 1, wherein the color gamut value and refresh rate value are remotely locked.

7. A display panel comprising:

a first light guide plate, wherein a set of high color gamut light emitting diodes (LEDs) provide a first illumination source;

a second light guide plate, wherein a set of narrow color gamut LEDs provide a second illumination source; and a switch to toggle the first illumination source and the second illumination source; and an LED driver, wherein the LED driver controls the switch, wherein the first light guide plate is planarly parallel to the second light guide plate and the set of high color gamut light emitting diodes are offset from the set of narrow color gamut LEDs wherein each of the set of high color gamut LEDs alternates position with each of the set of narrow color gamut LEDs, and wherein the LED driver receives a backlight signal from a time controller and the LED driver determines based on the backlight signal, to toggle the first illumination source or the second illumination source.

8. The display panel of claim 7, wherein the time controller synchronizes a display signal and the backlight signal to a configuration combination of a color gamut value and a refresh rate value.

9. The display panel of claim 8, wherein the color gamut value and refresh rate value are configurable from a user accessible application.

10. The display panel of claim 8, wherein the color gamut value and refresh rate value are remotely locked.

11. A non-transitory computer-readable medium comprising instructions executable by a processor to:

receive a display panel configuration;

send a backlight signal to a light emitting diode (LED) driver wherein the backlight signal indicates for the LED driver to toggle a set of high color gamut LEDs in a light guide plate or to toggle a set of narrow gamut LEDs in the light guide plate; and synchronizing a display signal and the backlight signal to a configuration combination of a color gamut value and a refresh rate value.

12. The non-transitory computer-readable medium of claim 11, further comprising instructions executable by a processor to:

send the display signal to a source driver and a gate driver, wherein the display signal indicates a refresh rate.

* * * * *